US008530130B2

(12) United States Patent
Uchino et al.

(10) Patent No.: US 8,530,130 B2
(45) Date of Patent: Sep. 10, 2013

(54) METHOD OF GLOSSY IMAGE FORMATION

(75) Inventors: Yasuko Uchino, Tokyo (JP); Tatsuya Nagase, Tokyo (JP); Asao Matsushima, Tokyo (JP); Aya Shirai, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 110 days.

(21) Appl. No.: 13/242,074

(22) Filed: Sep. 23, 2011

(65) Prior Publication Data

US 2012/0082493 A1 Apr. 5, 2012

(30) Foreign Application Priority Data

Sep. 30, 2010 (JP) ..... 2010-220603

(51) Int. Cl.
*G03G 15/20* (2006.01)

(52) U.S. Cl.
USPC ..... 430/124.1; 430/124.11; 430/124.14; 430/124.3

(58) Field of Classification Search
USPC ..... 430/124.1, 124.11, 124.14, 124.3
See application file for complete search history.

(56) References Cited

U.S. PATENT DOCUMENTS

| | | | | |
|---|---|---|---|---|
| 2005/0214669 | A1* | 9/2005 | Hayashi et al. | 430/109.4 |
| 2005/0244202 | A1* | 11/2005 | Aslam et al. | 399/341 |
| 2010/0183966 | A1* | 7/2010 | Kadokura et al. | 430/107.1 |
| 2010/0183968 | A1* | 7/2010 | Sugawara et al. | 430/108.1 |
| 2010/0189964 | A1* | 7/2010 | Kitagawa | 428/195.1 |
| 2010/0209835 | A1* | 8/2010 | Takahashi et al. | 430/105 |

FOREIGN PATENT DOCUMENTS

| | | |
|---|---|---|
| JP | 11-007174 | 1/1999 |
| JP | 2002-341619 | 11/2002 |
| JP | 2004-258537 | 9/2004 |
| JP | 2007-140037 | 6/2007 |

* cited by examiner

*Primary Examiner* — Hoa V Le
(74) *Attorney, Agent, or Firm* — Lucas & Mercanti, LLP

(57) ABSTRACT

A method of forming a glossy image is disclosed, comprising the steps of (a) forming a clear toner particle layer with clear toner particles on an image support, (b) heating and pressing the clear toner particle layer formed on the image support, while bringing the surface of the clear toner particle layer into contact with a belt, and (c) cooling the clear toner particle layer to form a clear toner layer, wherein the clear toner particles contain a binder resin and a releasing agent and exhibit a heat quantity of fusion of not less than 3.0 J/g and not more than 9.5 J/g, and the clear toner particles meeting the following requirement:

$0.5 \leq S2/S1 \leq 1.0.$

8 Claims, 6 Drawing Sheets

METHOD OF GLOSSY IMAGE FORMATION

This application claims priority from Japanese Patent Application No. 2010-220603, filed on Sep. 30, 2010, which is incorporated here into by reference.

FIELD OF THE INVENTION

The present invention relates to a method of forming glossy images.

BACKGROUND OF THE INVENTION

Photographic images or images as typified by a poster have been prepared by a conventional silver salt photographic system or printing system such as gravure printing but recently are also prepared by an ink jet printer or an electrophotographic image forming apparatus.

In the field of an image forming technology of an electrophotographic system for copiers or printers, for instance, reproduction of minute dot images at a level of 1200 dpi [in which "dpi" refers to the number of dots per inch (2.54 cm)] has become feasible along with development of technologies, such as digitization of an exposure system or reduction of toner particle sizes. Further, there has been developed a technology in which toner images are formed on plural photoreceptor drums, the formed toner images are primarily transferred to an intermediate transfer material to be superimposed and the toner images transferred onto the intermediate transfer material are secondarily transferred to an image support, permitting full color image formation. Thus, formation of full-color images requiring enhanced resolution, such as photographic images, has become feasible through development of image forming technologies, in addition to silver salt photography or conventional printing technology.

Images including a photographic image, such as a poster or the like, often require glossy images. When forming a photographic image by using a toner, for example, a toner image area fixed on an image support such as paper exhibits a certain extent of gloss but the white background region results in little gloss finishing. Such unbalanced finishing in gloss between an image area and a non-image area often vitiates image quality and therefore, a countermeasure has been desired.

From the foregoing background, there was studied a technique to eliminate unevenness in glossiness on the image in which image formation was performed by using a called clear toner having removed colorant components from usual toner. For instance, there was disclosed a technique in which a clear toner was supplied onto an image support having thereon a printed image and subjected to thermal fixing to form a clear toner particle layer, and thereby forming an image exhibiting uniform glossiness on the overall surface (as described in, for example, JP 11-007174 A).

There was also disclosed a technique in which a clear tone particle layer comprised of a clear toner was formed on a printed image prepared by an electrophotographic image forming apparatus, followed by formation of a clear toner layer by using a glossing device to form a glossy image (as described in, for example, JP 2002-341619 A and 2004-258537 A). In this technique, a clear toner particle layer was formed by an electrophotographic image forming apparatus and then, the clear tone particle layer surface was heated with being brought into contact with a belt of a glossing device to melt the clear toner particles and then cooled to form a glossy image.

There was also disclosed a technique of glossy image formation, in which the difference in particle size between a color toner and a clear toner was noted to achieve uniform gloss (as described in, for example, JP 2007-140037 A).

As disclosed above, a clear toner layer was formed on the image layer surface by using a clear toner, rendering it feasible to form a glossy surface with a certain extent of smoothness, whereby a glossy image was obtained.

However, it was proved that problems arose with formation of glossy images by using a clear toner disclosed in the foregoing techniques such that wrapping onto the heating roll of a heat-fixing device of an electrophotographic image forming apparatus occurred or a highly and evenly glossy image was not obtained even when using a glossing device.

SUMMARY OF THE INVENTION

Accordingly, it is an object of the present invention to provide a method of forming a glossy image in which wrapping onto the heating roll of an oilless type heat-fixing device does not occur even when forming a clear tone particle layer on an image support by using a clear toner in an electrophotographic image formation apparatus and formation of a highly even glossy image (for example, exhibiting a glossiness of at least 80 at a measurement angle of 20°) is stably achieved by passing through an oilless type pressure heating means and a cooling-releasing means of a glossing device.

The foregoing object of the present invention can be realized by the following constitution.

1. Namely, one aspect of the present invention is directed to a glossy image forming method comprising the steps of:

(a) forming a clear toner particle layer with clear toner particles on an image support, (b) heating and pressing the clear toner particle layer formed on the image support, while bringing the surface of the clear toner particle layer into contact with a belt, and then (c) cooling the clear toner particle layer to form a clear toner layer, wherein the clear toner particles contain a binder resin and a releasing agent and exhibit a heat quantity of fusion of not less than 3.0 J/g and not more than 9.5 J/g, and the clear toner particles meeting the following requirement:

$$0.5 \leqq S2/S1 \leqq 1.0$$

Wherein, when a clear tone particle is cut so as to pass through its center of gravity, S1 represents a total area of releasing agent domains in a cross section of a clear toner particle and S2 represents a total area of releasing agent domains which exist within a region of 2 μm from the particle surface toward the center of gravity of the particle.

The method of forming a glossy image of the present invention does not cause wrapping onto the heating roll of an oilless type heat-fixing device even when forming a clear tone particle layer on an image support by using a clear toner in an electrophotographic image formation apparatus and formation of a highly even glossy image (for example, exhibiting a glossiness of at least 80 at a measurement angle of 20°) is stably achieved by passing through an oilless type pressure heating means and a cooling and releasing means of a glossing device, whereby superior effects are achieved.

DETAILED DESCRIPTION OF THE INVENTION

Figure 1:
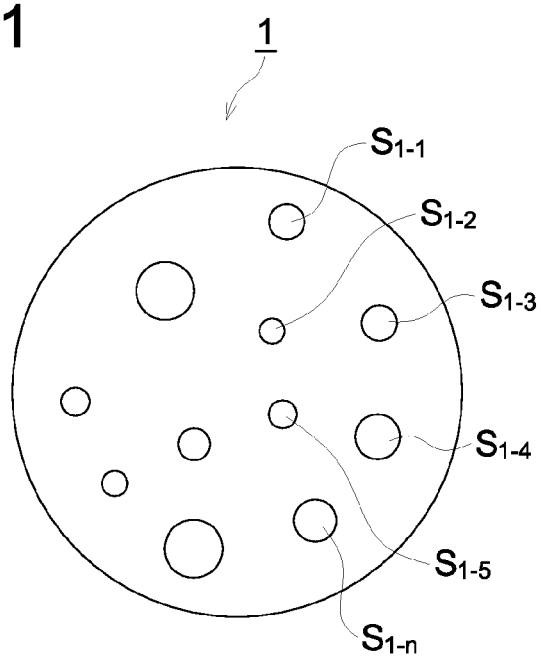
FIG. 1 shows a schematic view of releasing agent domains existing in the section of a clear tone particle.

There was studied by the inventors a method of forming a glossy image in which wrapping onto the heating roll of an oilless type heat-fixing device was not caused even when forming a clear tone particle layer on an image support by using a clear toner in an electrophotographic image formation apparatus and formation of a highly even glossy image (for example, exhibiting a glossiness of at least 80 at a measurement angle of 20°) was stably achieved by passing through an oilless type pressure heating means and a cooling-releasing means of a glossing device.

As a result of extensive study, it was proved that specification of a heat quantity of fusion and the position of releasing agent domains existing within a clear toner particle inhibited occurrence of wrapping onto the heating roll of an oilless type heat-fixing device, and passing through an oilless type pressure heating means and a cooling-releasing means of a glossing device rendered it feasible to obtain a highly even glossy image.

Specifically, the clear toner contains a hinder resin and a releasing agent and its heat quantity of fusion (ΔH) is not less than 3.0 J/g and not more than 9.5 μg at the time of temperature rise in a DSC curve determined in differential scanning calorimetry, and the total area (S1) of releasing agent domains in the section of a clear toner particle and the total area (S2) of releasing agent domains existing within a region of 2 μm in a direction toward the center of gravity from the particle surface meet the following requirement:

$$0.5 \leqq S2/S1 < 1.0.$$

The use of a clear toner related to the present invention does not cause wrapping onto the heating roll of an oilless type heat-fixing device and a highly even gloss image can be obtained by passage through an oilless type pressure heating means and a cooling-releasing means of a glossing device (or glossiness-providing device).

The reason for a highly even-glossy image obtained by passage through an oilless type pressure heating means and a cooling-releasing means of a glossing device is presumed to be that the quantity of heat which is lost in fusion of a releasing agent as an endothermic reaction is lessened and the heat quantity which is externally supplied is effectively used for softening of clear toner particles, and thereby, a clear toner particle layer is softened by the pressure-heating means to form the smoothened surface of the clear toner layer by the belt surface of the cooling-releasing means, as if it is pressed by a domestic iron, whereby a highly glossy image is achieved.

The reason for prevention of wrapping onto the heating roll of an oilless type heat-fixing device is also presumed to be that since releasing agent domains are allowed to exist near the clear toner particle surface, the releasing agent effectively bleeds out onto the clear toner particle surface to achieve releasing effect when thermally fixing a toner on the image support and further, even when fixing at high-speed.

First, there will be described definition of the terms used in the present invention.

Glossy Image:

The glossy image defined in the present invention refers to an image provided on an image support, of which all or part of the surface is covered with a clear toner layer.

Image Support:

An image support defined in the present invention refers to a support used to form a printed image and a clear toner layer.

The image support usable in the present invention may be any one which can form a toner image by using an electrophotographic image forming apparatus installed with an oilless heat-fixing device and can also hold a clear toner layer on the toner image, and the image support may employ one commonly known in the art. Examples of such a commonly known image support include plain paper including thin paper and thick paper, fine-quality paper, printing paper such as art paper or coated paper, paper used for commercially available post cards and plastic film used for OHP.

Image:

The image defined in the present invention refers to one which makes a form as a medium providing information to a user, for example, like a text image or a picture image. Namely, the image refers to not only an area having a toner or ink on an image support, a so-called image area but also an area including a non-image area, a so-called white background. Thus, the image defined in the present invention refers to an image area formed of a toner or ink and an area including a non-image area in which neither toner nor ink exists, that is, a white background.

In the present invention, methods of preparing an image before forming a clear toner particle layer are not specifically limited and include commonly known image forming methods, such as an electrophotographic system, a printing system, an ink-jet system, and a silver salt photography system.

Clear Toner:

The clear toner cited in the present invention refers to a toner not containing a coloring agent exhibiting color through an action of light absorption or light scattering (for example, a coloring pigment, a coloring dye, black carbon particles and a black magnetic powder). The clear toner is usually not colored and transparent but one or another clear toner exhibits lowered transparency due to the kind or content of a binder resin, wax, or additive, but refers to one not containing any colorant in the present invention.

In the present invention, the clear toner refers to an aggregate of clear toner particles.

Clear Toner Particle Layer:

The clear toner particle layer cited in the present invention refers to a layer formed on an image support and composed of clear toner particles which are supplied from the clear toner particle layer-forming section of an electrophotographic image forming apparatus.

Clear Toner Layer:

The clear toner layer cited in the present invention refers to a layer obtained by melting a clear toner particle layer formed on an image support with pressing and heating, followed by cooling. The clear toner layer is formed preferably by using a clear toner in an amount of not less than 2 g/m$^2$ and not more than 15 g/m$^2$. A clear toner layer formed of an amount falling within such a range can form a highly even-glossy image and is also superior in abrasion resistance.

Image Glossiness:

The glossiness of an image, cited in the present invention is a value determined when quantitatively measuring the extent of reflection on the image surface while the image surface is exposed to light under prescribed conditions.

The glossiness of an image is determined in the manner that an area of a clear toner layer on an image is measured randomly at five point by a glossmeter (GMX-203, produced by Murakami Shikisai-gijutsu Kenkyuusho Co., Ltd.) at an incident angle of 20° in accordance with JIS Z 8741 1997, and the average value thereof is defined as glossiness of the image.

In the following, the present invention will be described in detail.

Clear Toner:

It is preferred for formation of a glossy image to use a toner of a reduced releasing agent content and a lessened heat quantity of fusion. However, reduction of releasing agent content easily causes wrapping onto the heating roll of an electrophotographic image forming apparatus or on the belt of a glossing device.

It was found by the inventors of the present invention that the use of a toner in which the location of a releasing agent within a toner particle and the heat quantity of fusion were specified, rendered it feasible to prevent an image support from being wrapped onto an oil-less type heating roll or a belt.

The clear toner used in the present invention is featured in that the clear toner exhibits a heat quantity of fusion of not less than 3.0 J/g and not more than 9.5 J/g at the time of temperature rise in a differential scanning calorimetry (DSC) curve determined by a differential scanning calorimeter and the clear toner particles meet the following requirement:

$$0.5 \leqq S2/S1 < 1.0$$

wherein S1 represents the total area of releasing agent domains in the section of a clear toner particle and S2 represents the total area of releasing agent domains which exist within a region of 2 μm from the particle surface toward the center of gravity.

The clear toner exhibiting a heat quantity of fusion of not less than 3.0 J/g and not more than 9.5 J/g can be prepared by reducing the releasing agent content and the use of a releasing agent with a low heat quantity of fusion.

A heat quantity of fusion of a clear toner of 3.0 J/g or more renders it feasible to prevent wrapping onto a heating roller. Further, a heat quantity of fusion of a clear toner of 3.0 J/g or more renders it feasible to achieve a highly and uniformly glossy image.

The heat quantity of fusion (ΔH) refers to a heat quantity of fusion at the time of temperature rise in a differential scanning calorimetry (DSC) curve determined by using a differential scanning calorimeter and is measured by using DSC-7 differential scanning calorimeter (produced by Perkin Elmer Inc.).

The measurement is conducted as follows. A clear toner of 4.5-5.0 mg is precisely weighed to two places of decimals, sealed into an aluminum pan (Kit No. 0219-0041) and set into a DSC-7 sample holder. An empty aluminum pan is used as a reference. The temperature is controlled through heating-cooling-heating at a temperature-rising rate of 10° C./min and a temperature-lowering rate of 10° C./min in the range of 0 to 200° C.

The heat quantity of fusion of a clear toner is represented as an energy quantity (J/g) calculated from an area sectioned by an endothermic peak and the base line in the region except for the endothemlic peak of a resin.

Figure 2:
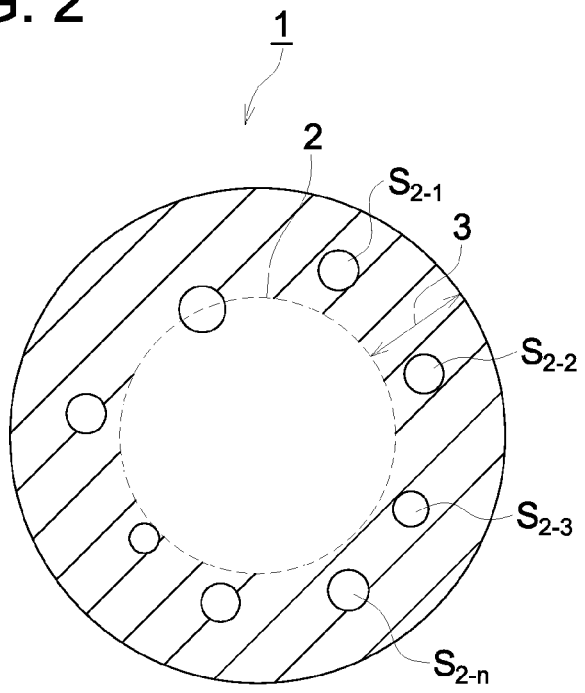
FIG. 2 shows a schematic view of releasing agent domains existing in the section within a region of 2 μm from the toner particle surface toward the center of gravity.

Releasing Agent Domain:

A clear toner used in the present invention exhibits a structure in which releasing agent domains are formed in a clear toner particle. The releasing agent domains refer to islands of a sea-island structure when observing the section of a clear toner particle and correspond to the region designated by plural circles, as shown in FIG. 1 and FIG. 2.

In the present invention, releasing agent domains allowed to exist in the vicinity of the surface of a clear toner particle so that the releasing agent easily bleeds out on the surface of the clear toner particle, whereby a maximum releasing effect is achieved by a small amount of a releasing agent.

One feature of a clear toner used in the present invention is that clear toner particles are allowed to exist so that S2/S1 is not less than 0.5 and not more than 1.0, in which S1 represents the total area of releasing agent domains in the section of a clear toner particle and S2 represents the total area of releasing agent domains which exist within a region of 2 μm from the particle surface toward the center of gravity.

A clear toner exhibiting S2/S1 of not less than 0.5 can be obtained by allowing a releasing agent to be contained only in the shell layer of a clear toner particle of a core/shell structure, or by using a highly polar releasing agent and allowing the releasing agent to be oriented toward the surface of a clear toner particle.

FIG. 1 shows a schematic view of releasing agent domains existing in the section when cutting a clear tone particle so as to pass through its center of gravity. In FIG. 1, the numeral 1 designates the section of a clear particle which is cut so as to pass through the center of gravity and designations, $S_{1-1}$, $S_{1-2}$, $S_{1-3}$, $S_{1-4}$, $S_{1-5}$, . . . $S_{1-n}$, each shows a releasing agent domain.

When a clear tone particle is cut so as to pass through its center of gravity, FIG. 2 shows a schematic view of releasing agent domains existing in the section within a region of 2 μm from the toner particle surface toward the center of gravity.

In FIG. 2, the numeral 1 designates the section of a clear particle which is cut so that the cut passes through the center of gravity, the numeral 2 designates a line drawn at a distance of 2 μm from the surface toward the center of gravity, the numeral 3 designates a distance of 2 μm from the surface of the clear toner particle toward the center of gravity, and designations, $S_{2-1}$, $S_{2-2}$, $S_{2-3}$, . . . $S_{1-n}$ show releasing agent domains existing within a region of 2 μm from the toner particle surface toward the center of gravity.

The total area (S1) of releasing agent domains existing on the clear toner particle section is the sum of $S_{1-1}$, $S_{1-2}$, $S_{1-3}$, $S_{1-4}$, $S_{1-5}$, . . . $S_{1-n}$.

The total area (S2) of releasing agent domains existing within a region of 2 μm from the clear toner particle surface toward the center of gravity is the sum of $S_{2-1}$, $S_{2-2}$, $S_{2-3}$, . . . $S_{1-n}$. In the case of a domains existing on the boundary line, only an area falling within the boundary line is counted.

The total area (S1) of releasing agent domains existing on the clear toner particle cross-section and the total area (S2) of releasing agent domains existing within a region of 2 μm from the clear toner particle surface toward the center of gravity are those measured from an electron micrograph of the sectional layer of a clear toner particle, photographed by a transparent electron microscope. There are usable commercially available transmission electron microscopes, and including, for example, LEM-2000 (produced by Topcon Co., Ltd.) and JEM-2000 FX (produced by Nippon Denshi Co., Ltd.).

Specifically, after dispersing clear toner particles sufficiently in a curable acryl resin, the resin is cured so as burry the particles within the cured resin, and from the obtained block, a thin film sample is sliced by using a microtome installed with a diamond knife-edge. The thus sliced sample is optionally dyed with a stain using ruthenium (VIII) oxide and osmium (VIII) oxide singly or in combination, whereby the resin portion or releasing agent domains are dyed so as to distinguish the resin portion from the releasing agent domains. Thereafter, photographing is performed by a transparent electron microscope at a magnification (approximately 10,000-fold) by using a transmission electron microscope (FEM).

The total are of releasing agent domains (S1) and the total are of releasing agent domains (S2) can be determined by subjecting the thus photographed image data to image processing by using, for example, LUZEX F (produced by NIRECO Co., Ltd.). An average value of S1 and an average value of S2 are calculated with respect to 100 clear toner particles in accordance with the foregoing method and the ratio of S2 to S1 (S2/S1) is determined from these average values.

Volume-Based Median Diameter ($D_{50}$):

The volume-based median diameter ($D_{50}$) is preferably not less than 5 μm and not more than 12 μm.

The volume-based median diameter ($D_{50}$) can be determined by using a measurement apparatus in which a Coulter Multisizer 3 (produced by Beckmann Coulter Co.) is connected to a computer system installed with software for data processing (Software V3. 51).

Specifically, a clear toner in an amount of 0.02 g is treated with a 20 ml surfactant solution (in which a neutral detergent containing a surfactant component is diluted 10 times with pure water) and then subjected to ultrasonic dispersion for 1 min. to prepare a toner dispersion. The toner dispersion is introduced by a pipette into a beaker containing ISOTON II (produced by Beckman Coulter Co.), placed in a sample stand until reaching a measured concentration of 5 to 10% and the analyzer count is set to 25000 particles. Using Coulter Multisizer 3 of an aperture diameter of 50 μm, a measurement range 1.0 to 30 μm is divided into 256 sections to calculate frequency and the particle size of a volume fraction of 50%, integrated from the larger side, is determined as a volume-based median diameter ($D_{50}$).

Material Constituting Clear Toner:

A clear toner used in the present invention contains at least a resin and a releasing agent.

Releasing Agent:

In the present invention, there is preferably used a releasing agent which effectively prevents wrapping onto a heating roll or belt, exhibits a small heat of fusion and is partially compatible with a resin.

Specific examples of a releasing agent include a low molecular weight polyolefin such as polyethylene, polypropylene or polybutene; silicones exhibiting a softening point upon heating; a carboxylic acid amide such as oleic acid amide, erucamide, or ricinolic acid amide; plant wax such as carnauba wax or rice wax; animal wax such as beeswax; mineral/petroleum wax such as montanic acid wax, ceresin, paraffin, or Fisher Tropsch wax. Preferred examples include esters of a long chain alkyl mono-alcohol having 12 to 30 carbon atoms and a higher carboxylic acid having 12 to 30 carbons, such as stearyl stearate, palmityl palmitate, and behenyl behenate; esters formed of a polyvalent carboxylic acid and a long chain alkyl alcohol having 12 to 30 carbons, such as dibehenyl itaconate, distearyl maleate and tristearyl aconitate; esters formed of a polyvalent alcohol and a higher carboxylic acid, such as tristearic acid glyceride, tribehenic acid glyceride, pentaerythritol tetrabehenate, and pentaerythritol stearate; esters of a higher carboxylic acid having 12 to 30 carbons and a polyvalent alcohol, such as tetrastearic acid diglyceride, tetrabehenic acid diglyceride, hexabehenic acid triglyceride, dekastearic acid ecaglyceride, and dipentaerythritol hexastearate; sorbitan higher carboxylic acid esters such as sorbitan tristearate, sorbitan tribehenate and sorbitan trioleate; and cholesterol carboxylic acid esters such as cholesterol stearate, cholesterol behenate, and cholesterol oleate. These are chosen depending on melting point, fusion viscosity or heat quantity of fusion.

A releasing agent used in the invention preferably is one which exhibits a heat quantity of fusion of not less than 80 J/g and not more than 250 J/g. The use of a releasing agent exhibiting a fusion heat quantity falling within this range makes it easy to obtain a clear toner exhibiting a fusion heat quantity of not less than 3.0 J/g and not more than 9.5 J/g. The fusion heat quantity of a releasing agent can be determined in a manner similar to the clear toner.

The amount of a releasing agent contained in a clear toner is preferably not less than 0.5% by mass and not more than 5.0% by mass of the total mass of the clear toner.

A releasing agent used in the invention preferably exhibits a melting point of not less than 50° C. and not more than 100° C. The use of a releasing agent exhibiting a melting point falling within this range effectively prevents wrapping onto a heating roll or belt.

Resin:

The clear toner used in the present invention preferably has a structure comprising a shell layer containing a releasing agent and provided on the outside of a core portion not containing a releasing agent.

A resin constituting the core portion is preferably formed of a styrene-acryl resin in terms of fixability.

Styrene monomers and acrylic acids which are capable of forming a styrene acryl resin are shown below, but styrene monomers and acrylic acid monomers usable in the present invention are by no means limited to these.

Specific examples of a styrene monomer include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-buthylstyrene, p-n-octylstyrene, p-n-nonylstyrene, p-n-decylstyrene, and p-n-dodecylstyrene.

An acrylic acid ester monomer is typified by an acrylic acid ester monomer and a methacrylic acid ester monomer, as below. Examples of an acrylic acid ester monomer include methyl acrylate, ethyl acrylate, isopropyl acrylate, n-butyl acrylate, t-butyl acrylate, iso-butyl acrylate, n-octyl acrylate, 2-ethylhexyl acrylate, stearyl acrylate, lauryl acrylate and phenyl acrylate.

Examples of a methacrylic acid ester include methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

These acrylic acid ester monomers and methacrylic acid ester monomers may be used singly or in combination of two or more of them. Namely, it is feasible to form a copolymer by use of a styrene monomer and two or more acrylic acid ester monomers, to form a copolymer by use of a styrene monomer and two or more methacrylic acid ester monomers or to form a copolymer by use of a styrene monomer and at least an acrylic acid ester monomer and a methacrylic acid ester monomer.

A resin forming a shell layer preferably exhibits a softening point higher than that of a resin forming the core portion, but there is no problem in resins exhibiting identical thermal characteristics.

Next, there will be described preparation of a clear toner usable in the present invention.

Preparation of Clear Toner:

Preparation of a Clear Toner Usable in the Present Invention May Employ Various Methods and includes a preparation method comprising a step of allowing resin particles used for the core portion to be aggregated to form a core portion and a step of allowing resin particles used for a shell layer to be attached to the surface of the core portion to form clear toner particles having a core/shell structure.

A preparation method of a clear toner is described below with reference to an example.

A clear toner used in the present invention is prepared by a process comprising the steps of:

(1) polymerizing a polymerizable monomer to prepare a dispersion of resin particles used for a core portion, (2) polymerizing a polymerizable monomer to prepare a dispersion of resin particles used for a shell portion, (3) allowing the resin particles used for a core portion to be aggregated to form core portions, (4) ripening the core portions with a heat energy to control the shape thereof, (5) adding a dispersion of resin particles used for a shell layer and a releasing agent dispersion to a dispersion of the core portions and allowing the resin particles used for a shell layer and the releasing agent to be aggregated and fused to form a shell layer, and forming particles of a core/shell structure, (6) ripening the particles of a core/shell structure with heat energy to control the shapes of the particles of a core/shell structure, and preparing a dispersion of toner parent particle, (7) cooling the dispersion of toner parent particles and then separating the toner parent particles through solid-liquid separation to remove a surfactant or the like from the toner parent particles (washing step), (8) drying the thus washed toner parent particle (drying step), and (9) adding external additives to the dried particles as needed.

In the preparation of a clear toner used in the present invention, first, resin particles for a core are aggregated and fused to form a core portion. Then, a dispersion of resin particles used for a shell layer and a releasing agent dispersion are added to allow the resin particles used for a shell layer and the releasing agent to be aggregated and fused onto the surface of the core portion to form a shell layer, whereby toner parent particles having a core/shell structure of covering the surface of the core portion with a shell layer containing the releasing agent.

Clear toner used in the present invention is preferably comprised of clear toner particles formed of a shell of a thin even layer and having a uniform small shape. Clear toner particles of such a structure and a shape are prepared in the manner that core particles of a uniform size and shape are formed and further thereto, resin particles to form a shell layer are added to perform shelling. When performing shelling, the shape of toner particles is finally controlled to form an appropriate shape and to achieve this, it is most important to prepare core particles of uniform size and shape. Accordingly, on the surfaces of such core particles are uniformly attached resin particles used for a shell layer, leading to preparation of clear toner particles with a uniformly thick shell layer.

The shape of such core particles can be controlled by control of a heating temperature in the step of aggregation and fusion and control of heating temperature and time in the step of ripening. In particular, it is most effective to control the time in the ripening stage. Namely, the ripening step is intended to control the circularity of a core particle, so that the intended circularity is achieved by control of the time.

A shell layer constituting a clear toner particle is formed preferably in the manner that a releasing agent component is dissolved or dispersed in a dispersion of a polymerizable monomer to form a resin and further mechanically dispersed in a fine particulate form, followed by polymerization of the polymerizable monomer by a process of mini-emulsion polymerization to form composite resin particles, and thus formed resin particles are subjected to salting-out and fusion. When dissolving a releasing agent component in the polymerizable monomer, the releasing agent component may be dissolved through solution or fusion.

In the following, there will be described a surfactant, a polymerization initiator and external additives which are employed in the preparation of a clear toner used in the present invention.

Surfactant:

When performing polymerization of a polymerizable monomer, as described above, the polymerizable monomer is required to be dispersed in an aqueous medium in the form of oil-droplets by using a surfactant. Such a surfactant is not specifically restricted but ionic surfactants described below are preferred.

Examples of an ionic surfactant include a sulfonate (e.g., sodium dodecylbenzene sulfonate, sodium aryl alkyl polyether sulfonate, sodium 3,3-disulfonediphenyl urea-4,4-diazo-bis-amino-8-naphthol-6-sulfonate, o-carboxybenzene-azo-dimethylaniline, sodium 2,2,5,5-tetramethyltriphenylmethane-4,4-diazo-bis-β-naphthol-6-sulfonate), a sulfuric acid ester salt (e.g., sodium dodecylsulfate, sodium tetradecylsulfate, sodium pentadecylsulfate, sodium octylsulfate), and a carboxylate (e.g., sodium oleate, sodium laurate, sodium caprate, sodium caprylate, sodium caproate, potassium stearate, calcium oleate).

There are also usable nonionic surfactants. Specific examples thereof include polyethylene oxide, polypropylene oxide, a combination of polyethylene oxide and polypropylene oxide, an ester of polyethylene glycol and a higher fatty acid, an alkylphenol polyethylene oxide, an ester of a higher fatty acid and polypropylene glycol, and a sorbitan ester.

Polymerization Initiator:

In the present invention, a resin constituting a core particle and a shell layer comprises a styrene-acryl copolymer resin which is formed through radical polymerization of a styrene monomer and an acrylic acid ester monomer. Commonly known oil-soluble or aqueous-soluble polymerization initiators are usable in formation of such a styrene-acryl copolymer resin. Examples of such an oil-soluble polymerization initiator include azo- or diazo-type polymerization initiators and peroxide polymerization initiators.

External Additive:

External additives are not specifically restricted and various kinds of inorganic particles, organic particles and lubricants. Preferred examples of inorganic particles include inorganic oxide particles of silica, titania, alumina or the like. Such inorganic particles are preferably subjected to a hydrophobilization treatment.

An external additive is added preferably in an amount of not less than 0.1% by mass and not more than 5.0% by mass of the toner, and more preferably, not less than 0.5% by mass and not more than 4.0% by mass. External additives may be added singly or in combination of them.

Developer:

The clear toner used in the present invention is usable as a single component clear toner developer or a two-component clear toner developer. In cases when used as a two-component clear toner developer by mixing it with a carrier, magnetic particles as such a carrier may employ commonly known materials, as typified by iron-containing magnetic particles such as iron, ferrite or magnetite, of which ferrite particles or magnetite particles are specifically preferred. The volume average particle size of the foregoing magnetic particles preferably is not less than 15 μm and not more than 100 μm, and more preferably, not less than 20 μm and not more than 80 μm. The volume average particle size of a earner can be measured by a laser diffraction type particle size distribution measurement device (HELOS, produced by SYMPATEC Limited Co.).

A carrier is preferably a coating carrier in which a magnetic particle is covered with a resin, or a so-called resin dispersion type carrier in which magnetic particles are dispersed in a resin. The resin used for coating is not specifically limited and examples thereof include a olefin resin, a styrene resin, a styrene-acryl resin, a silicone resin, an ester type resin and a fluorine-containing polymer resin. A resin to constitute a resin dispersion type carrier also is not specifically restricted and examples thereof include a styrene-acryl resin, a polyester resin, a fluoro-resin and a phenol resin.

The mixing ratio of carrier to clear toner by mass (carrier: clear toner) is preferably in the range of 1:1 to 50:1.

Next, there will be described a formation method of a glossy image. In the glossy image formation method of the present invention, a printed image having a clear toner particle layer is formed on an image support by using a clear toner and the formed printed image is heated and pressured, and then cooled to prepare a glossy image provided with a clear toner layer.

Figure 3:
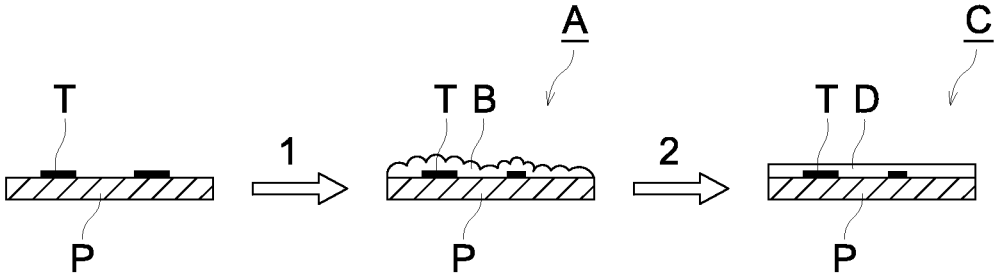
FIG. 3 shows a schematic depiction illustrating an image forming method comprising the steps of forming a clear toner particle layer and forming a clear toner layer.

FIG. 3 shows a schematic depiction illustrating an image forming method comprising the steps of forming a clear toner particle layer and forming a clear toner layer.

In FIG. 3, "P" designates an image support, "A" designates a printed image, "B" designates a clear toner particle layer, "C" designates a glossy image, "D" designates a clear toner layer, "T" designates a toner image, the numeral 1 represents a step of forming a clear toner particle layer and the numeral 2 represents a step of forming a clear toner layer.

The schematic depiction shown in FIG. 3 illustrates a glossy image forming method comprising the steps of forming a toner image (T) on an image support (P) by using an oilless type image forming apparatus, then, supplying a clear toner to the whole surface of the image support to form a printed image (A) provided with a clear toner particle layer (B), then, melting the clear toner particle layer (B), followed by being cooled to prepare a glossy image (C) provided with a smooth clear toner layer (D).

In the present invention, the oilless type image forming apparatus refers to an apparatus installed with a means for coating an oil (for example, silicone oil) onto the surface of a heating roll or a belt to improve releasability of an image support from the heating roll, or releasability of the image support from a belt of a glossing device. The use of an oil often causes glare due to the oil, resulting in uneven gloss.

Formation of Printed Image:

A printed image can be formed by providing a clear toner particle layer onto a toner image formed by an electrophotographic process, or by providing a clear toner particle layer onto a print printed by a printing method or the like.

In the following, there will be described a method of forming a printed image by providing a clear toner particle layer to a print prepared by an electrophotographic apparatus.

Figure 4:
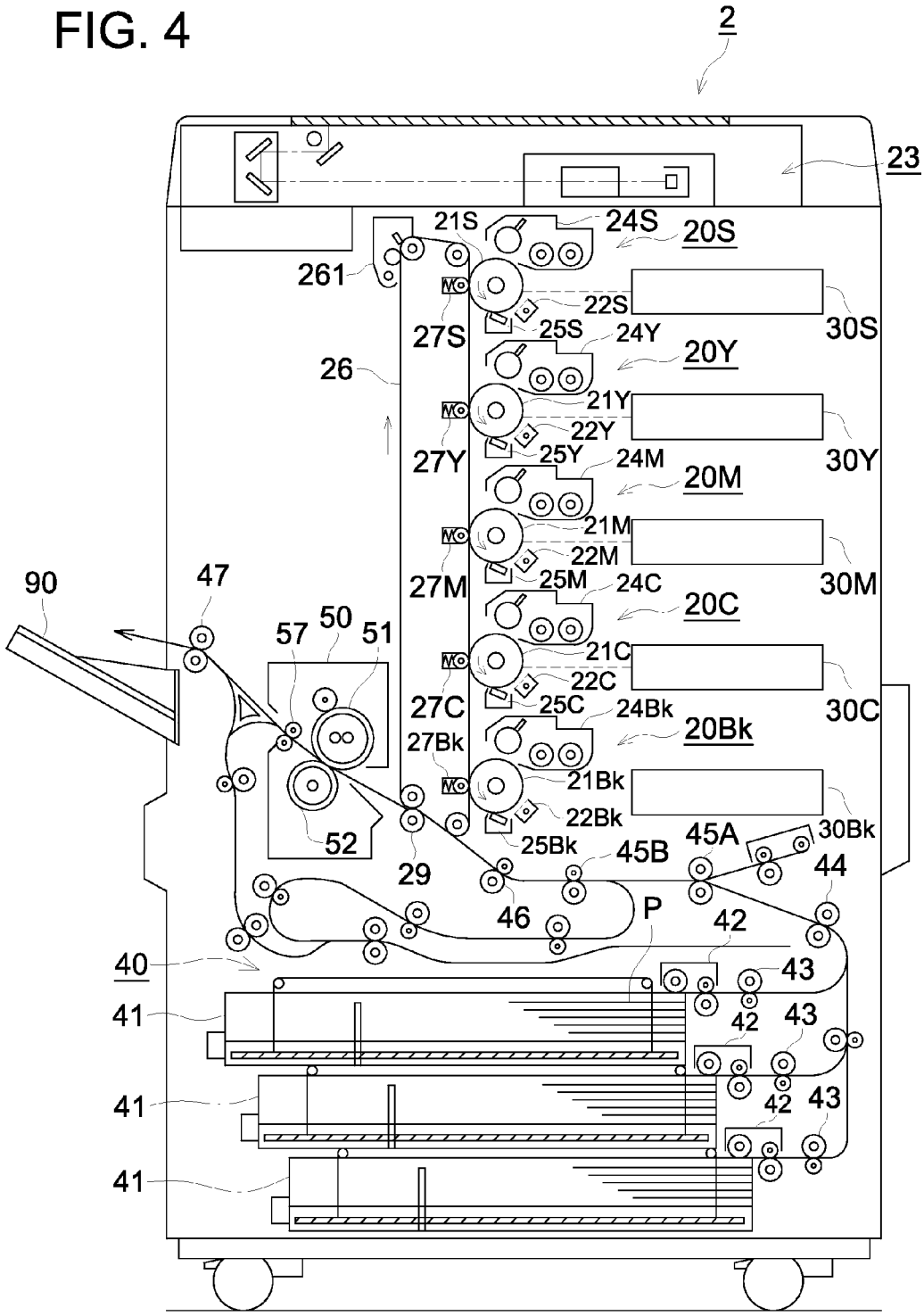
FIG. 4 is a schematic view of an example of an image forming apparatus capable of forming a printed image provided with a clear toner particle layer on the overall surface of an image support simultaneously with formation of a color toner image.

FIG. 4 is a schematic view of an example of an image forming apparatus capable of forming a printed image provided with a clear toner particle layer on the overall surface of an image support simultaneously with formation of a color toner image.

An image forming apparatus 2 shown in FIG. 4 is called a tandem color image forming apparatus, which is, as a main constitution, comprised of a clear toner particle layer forming section 20S, plural image forming sections 20Y, 20M, 20C and 20Bk; an intermediate transfer belt 26 of an endless belt form, a paper feeding device 40, a paper-feeding device 40 and a heat-fixing device 50.

An image reading section 23 is provided in the upper portion of the image forming apparatus 2. A manuscript placed on a manuscript-setting table is subjected to scanning exposure by an optical system of a manuscript image scanning exposure device in the image reading section 23 and read in line image sensor. Analog signals which were subjected to photoelectric conversion by a line image sensor, are further subjected to an analog treatment, A/D conversion, shading correction and an image compression treatment, and are inputted to exposure sections 30S, 30Y, 30M, 30C and 30Bk.

In the present invention, in cases when constituent elements are collectively designated, it is indicated by a reference code having an abbreviated alphabetical suffix; and in cases when the individual constituent element is referred to, it is indicated by a reference code with attached suffix of S (clear toner), Y (yellow), M (magenta), C (cyan) or Bk (black).

The image forming apparatus 2 shown in FIG. 4 is provided with a clear toner particle layer-forming section 20S forming a clear toner particle layer over the overall surface of the image support through an intermediate transfer belt 26, an yellow image forming section 20Y performing the yellow toner image formation, a magenta image forming section 20M performing a magenta toner image formation, a cyan image forming section 20Y performing a cyan toner image formation, and a black image forming section 20Bk performing a black toner image formation. These image forming sections comprise band electrodes (22S, 22Y, 22M, 22C, 22Bk), exposure sections (30S, 30Y, 30M, 30C, 30Bk), developing devices (24S, 24Y, 24M, 24C, 24Bk) and cleaners (25S, 25Y, 25M, 25C, 25Bk) which are provided around each of drum-formed photoreceptors, as a image carrier (21S, 21Y, 21M, 21C, 21Bk).

The photoreceptor comprises, for example, an organic photoreceptor in which a photosensitive layer comprised of a resin containing an organic photoconductor is formed on the outer circumference of a drum-form metal substrate, is disposed in the state of being stretched in the direction of the width of a transported image support P (in FIG. 4, for example, vertical direction to the plane of paper). The resin constituting the photosensitive layer may employ a commonly known resin used for a photosensitive layer, such as a polycarbonate resin. In FIG. 4, an embodiment using a drum-form photoreceptor is shown but the embodiments of the present invention are not limited to these but, for example, a belt-form photoreceptor may be used.

The developing devices, each includes a two-component developer comprised of a clear toner (S), a yellow toner (Y), a magenta toner (M), a cyan toner (C) or a black toner (Bk).

The intermediate transfer belt 26, as a intermediate transfer material is rotatably supported by plural rollers. For example, the intermediate transfer belt 26 is an endless belt exhibiting a volume resistance of $10^6$ to $10^{12}$ Ω·cm. The intermediate transfer belt 26 can be formed of a commonly known resin material, for example, polycarbonate (PC), polyimide (PI), polyamidoimide (PAI), polyvinylidene fluoride (PVDF), or tetrafluoroethylene-ethylene copolymer (ETFE). The thickness of the intermediate transfer belt 26 is preferably 50 to 200 μm.

A clear toner particle layer and the individual color toner images which are formed on each of the photoreceptors (21S, 21y, 21M, 21C, 21Bk) in each of a clear toner layer forming section 20S and toner image forming sections (20Y, 20M, 20C, 20Bk), are sequentially transferred to the rotating intermediate transfer belt 26 by each of primary transfer rollers 27S, 27Y, 27M, 27C, and 27Bk (primary transfer) to form a full-color image combined with a clear toner layer on the intermediate transfer belt 26. On the other hand, after image transfer, any residual toner is removed from the individual photoreceptors (21S, 21Y, 21M, 21C, 21Bk) by the cleaners (25S, 25Y, 25M, 25C, 25Bk).

An image support (P) housed within a paper housing section 41 (tray) of a paper feeder 40 is supplied by a first paper-feeding section 42 and transferred by a secondary transfer roller 29 to a secondary transfer roller 29 through paper-feeding rollers 43, 44, 45A and 45B and a resist roller 46 (second paper feeding section), whereby a clear toner particle layer and a color image are transferred onto the image support P (secondary transfer).

The three-stepped paper housing sections (41) have almost the same constitution and are designated by the same code. Three-stepped paper feeding sections (42) also have almost the same constitution and are designated by the same code. The paper housing sections (41) and the paper feeding sections (42) are inclusively named a paper feeder 40.

The image support P onto which a clear toner layer and a full-color image are transferred is sandwiched between a heating roller 51 and a pressure roller 52 of a heat-fixing device 50, and a clear toner and color toners are melted and solidified by heating and pressure. Thus, the heat-fixing device 50 fixes a full-color toner image on the clear toner particle layer formed on the overall surface of the image support P. The image support P is transferred, while being sandwiched by paired transfer rollers 57, nipped by a paper discharge roller 47 and put onto a paper discharge tray 90 outside the machine.

Meanwhile, after a clear toner particle layer and a color toner image are transferred onto the image support P by a secondary transfer roller 29, the intermediate transfer belt 26 separates the image support P through curvature separation; then, the toner remained on the intermediate transfer belt is removed by a cleaner 261 used for the intermediate transfer belt.

Glossy Image Formation:

In the following, there is described an exemplified method of forming a glossy image by the combination of an electrophotographic apparatus and a glossing device. Namely, a color toner image is formed on an image support by an electrophotographic system and further thereto, a clear toner is supplied to form a clear toner particle layer and a glossy image provided with a clear layer can be formed through a heating and pressure means and a cooling and transporting means of a glossing device.

Figure 5:
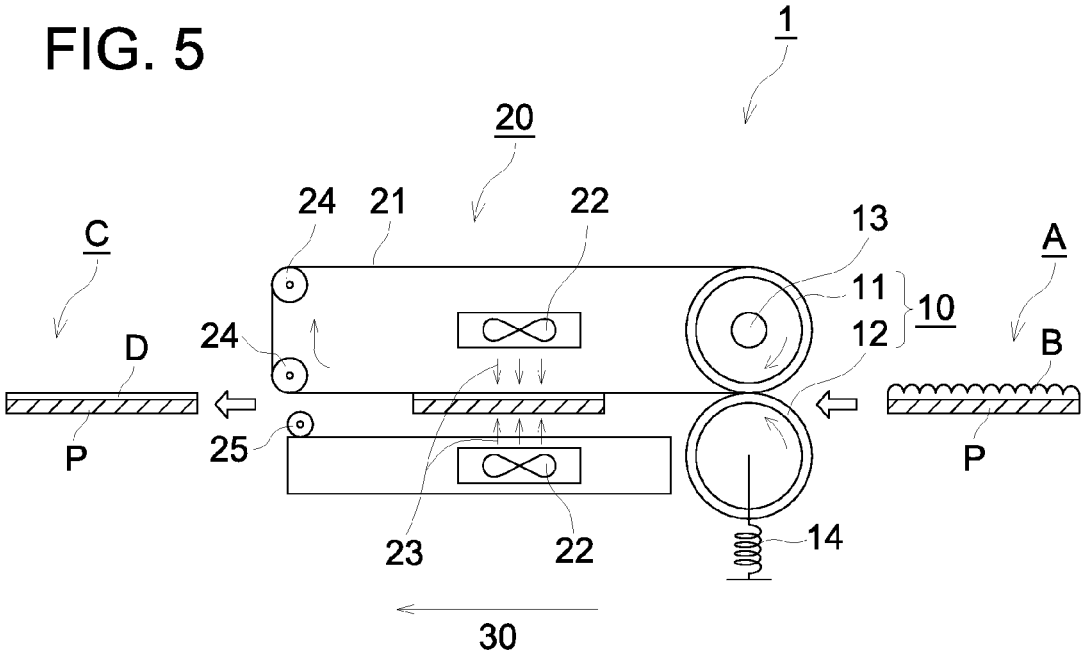
FIG. 5 illustrates a schematic view of an exemplified glossing device capable of forming a glossy image.

FIG. 5 illustrates a schematic view of an exemplified oilless glossing device capable of forming a glossy image. In FIG. 5, "P" designates an image support, "A" designates a printed image; "B", a clear toner particle layer; "C", a glossy image, "D", a clear toner layer; and the numeral 1 designates a glossing device; the numeral 10, a heating and pressurizing section; the numeral 11, a heating roll; the numeral 12, a pressure roll; the numeral 13, a heating source; the numeral 14, a pressure spring; the numeral 20, a cooling and transporting section; the numeral 21, a belt, the numeral 22, a cooling fan; the numeral 23, cooling air; the numeral 24, a transport roll; the numeral 25, a separation roll; and the numeral 30, the transport direction of a glossy image.

The glossing device 1, as shown in FIG. 5, is constituted of an oilless heating and pressurizing section 10 and a cooling and transporting section 20. In the heating and pressurizing section, a printed image A is transported at a constant speed, while being sandwiched between a heating roll 11 and a pressurizing roller 12, and a transported printed image A is heated and pressed, and then cooled. Namely, a clear toner particle layer B formed on the overall surface of an image support P is melted, while being heated and pressed, and then cooled to form a clear toner layer D.

The heating and pressurizing section has a structure in which a heating source 13 is enclosed inside the heating roll 11 and the pressurizing roll is provided with a pressuring spring.

The nip width between a pressure roll and a pressurizing roll preferably is from 2 to 18 mm.

A heating roll preferably is one which is comprised of an elastic layer comprised of a silicone rubber or the like, covering the surface of a metal substrate, such as aluminum. A halogen lamp such as a 300-350 W halogen lamp, as a heating source, is disposed in the interior of the heating roll, whereby the heating roll is internally heated so as to maintain a prescribed surface temperature.

A pressurizing roll is preferably comprised of a metal substrate such as aluminum, which is covered with an elastic layer comprised of a silicone rubber or the like and the surface of the elastic layer is further covered with a releasing layer of a tube made of PFA (tetrafluoroethylene/perfluoroalkylvinyl ether copolymer) and is formed to a prescribed outer diameter. A halogen lamp such as a 300-350 W halogen lamp, as a heating source, may be disposed in the interior of the pressurizing roll.

Next, there will be described a cooling and transporting section 20. The cooling and transporting section 20 is constituted of an endless belt 21 which is rotarily supported by a heating roll 11 and plural rolls 24, and a cooling means.

The belt is entrained about the heating roll and plural rolls so as to be driven at a prescribed driving rate by a driving source, not shown in FIG. 5.

An adhesion layer is formed between the belt and the surface of a melted clear toner layer, and the belt transports the image support P through the melted clear toner layer, so that the belt is prepared preferably with a material exhibiting a certain extent of heat resistance and mechanical strength. Examples thereof include heat resistant film resins such as polyimide, polyether-polyimide, PES (polyether sulfone resin), and PFA (polytetrafluoroethylene-perfluoroalkylvinyl ether). Further, it is preferred to provide a resin layer excellent in releasability, such as FIFE (polytetrafluoroethylene) or PFA onto the side which is to be brought into contact with the clear toner layer.

The thickness of the belt is not specifically limited if the image support can be transferred through the melted clear toner layer, and a thickness approximately from 30 to 130 μm is usable. For example, the thickness of a heat-resistant resin film is preferably 20 to 100 μm, and that of a releasing layer is preferably from 10 to 30 μm. A 80 μm thick polyimide endless film covered with a 30 μm thick silicone rubber layer is cited as a preferred embodiment.

A cooling fan 22 as a cooling means is provided on the inner surface side of the belt and below the belt. A clear toner layer formed on the image support P is forcedly cooled by cold air 23 blown from the cooling fan, while being transferred by the belt 11.

Thus, the clear toner layer on the image support P is forcedly cooled by cold air of the cooling fan, while being transferred by the belt, whereby solidification is accelerated. Further, the clear toner layer is sufficiently cooled and solidified until transferred to the position near the end portion of the belt where a separation roll 25 is disposed, and a glossy image C is peeled off at the end portion.

Figure 6:
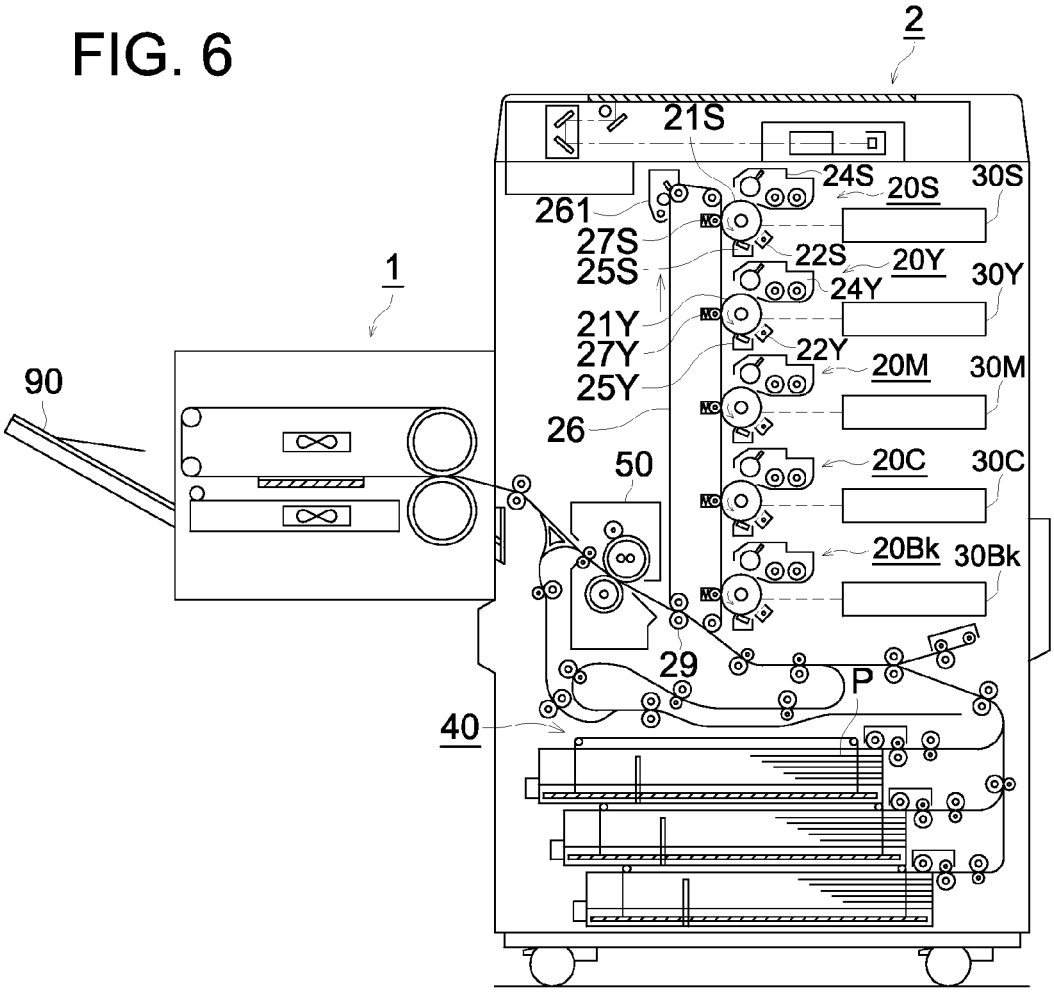
FIG. 6 shows a schematic view of an example of an image forming apparatus shown in FIG. 4 and further provided with a glossing device, as shown in FIG. 5.

FIG. 6 shows a schematic view of an example of an image forming apparatus, in which the image forming apparatus shown in FIG. 4 is further provided with a glossing (or gloss-providing) device shown in FIG. 5.

Namely, an oilless glossy image forming apparatus is shown in FIG. 6, in which the oilless glossing device 1 shown in FIG. 5 is disposed at the position of paper discharge tray 90 shown in FIG. 4. A clear toner particle layer which was fixed by the heat-fixing device 50 contained in the image forming apparatus shown in FIG. 4 is first formed on the image support and thereafter, a clear toner layer is formed through an oil-less heating and pressurizing means and a cooling/peeling means of the glossing device 1.

Figure 7:
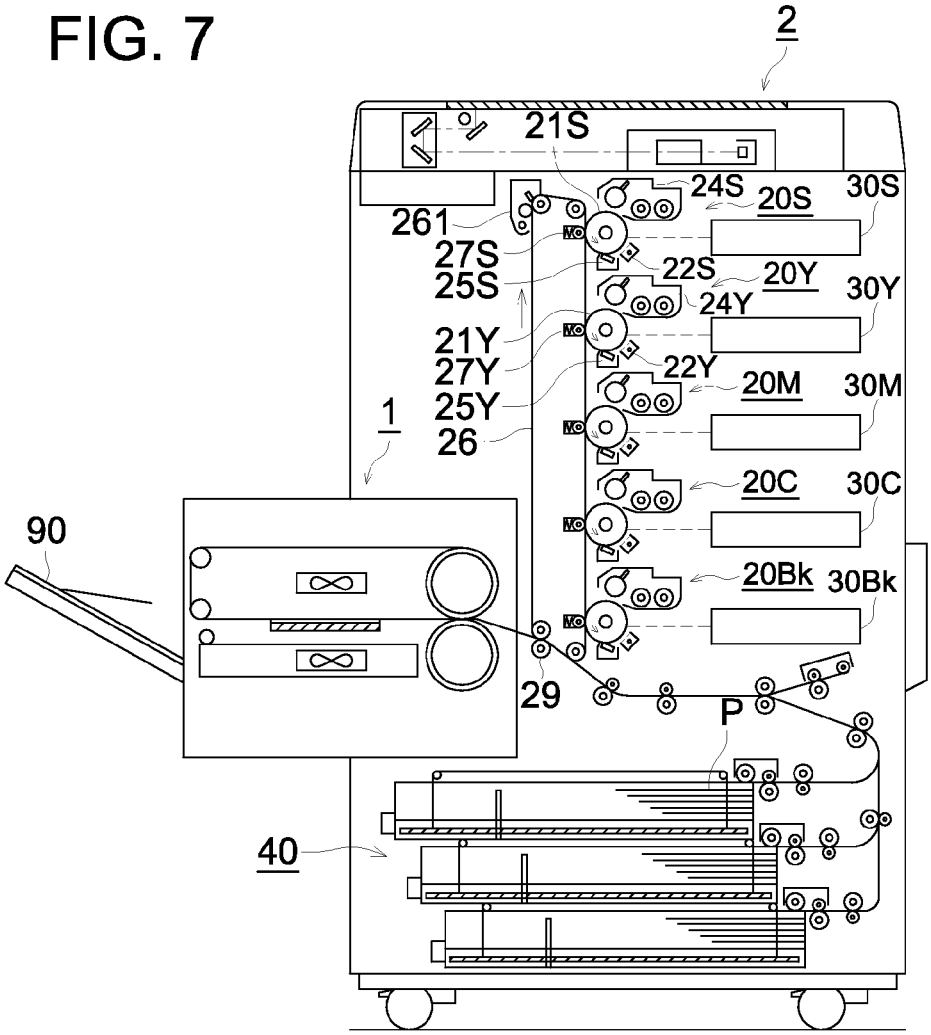
FIG. 7 shows a schematic view of an example of an image forming apparatus, in which the heat-fixing device of the image forming apparatus 2 shown in FIG. 4 is replaced by a glossing device, as shown in FIG. 5.

FIG. 7 shows a schematic view of an example of an image forming apparatus, in which the heat-fixing device of the image forming apparatus 2 shown in FIG. 4 is replaced by a glossing device, as shown in FIG. 5. Namely, FIG. 7 shows a glossy image forming apparatus, in which the heat-fixing device 50 of the image forming apparatus 2 shown in FIG. 4 is replaced by the glossing device 1, as shown in FIG. 5.

A glossy image prepared by a clear toner is employed for the usage requiring gloss and the usage requiring durability.

Such a glossy image exhibits enhanced surface strength and is also preferably used for preparation of a poster for outdoor notice.

A glossy image in which a clear toner layer is partially formed is transparent in the portion of the clear toner layer, enabling it to form a water-mark character.

EXAMPLES

The embodiments of the present invention will be further described with reference to examples but are by no means limited to these.

Preparation of Clear Toner

Clear toner particles were prepared by forming a shell layer on the core particle surface.

Preparation of Core Resin Particle Dispersion

Preparation of Core Resin Particle Dispersion 1:

Resin particles used for preparation of core resin particle dispersion 1 were prepared through two-step polymerization, as described below.

First Step Polymerization:

Into a reaction vessel equipped with a stirrer, a temperature sensor, a condenser and a nitrogen-introducing device was added a solution of 4 parts by mass of sodium polyoxyethylene (2) dodecy ether sulfate dissolved in 1300 parts by mass of deionized water and heated to 80° C. Further thereto, 450 parts by mass of styrene, 81 parts by mass of n-butyl acrylate, 38 parts by mass of methacrylic acid and 9 parts by mass of n-octylmercatan, which were heated to 80° C., were added and mixed to obtain a mixture. The mixture was further mixed over 30 minutes by a mechanical disperser provided with a circulation path (CREAM, produced by M-Technique Co., Ltd.) to obtain a dispersion containing emulsified particles (oil droplets).

Subsequently, 20 parts by mass of potassium persulfate dissolved in 350 parts by mass of deionized water were added to the dispersion and stirred with heating at 80° C. over 1 hour to prepare a resin particle dispersion.

Second Step Polymerization:

To the foregoing resin particle dispersion was added 20 parts by mass of potassium persulfate dissolved in 200 parts by mass of deionized water and further thereto, a monomer solution composed of 492 parts by mass of styrene, 70 parts by mass of n-butyl acrylate and 7 parts by mass of n-octylmercaptan were dropwise added over 3 hours under a temperature condition of 80° C.

After completing addition, the mixture was further stirred over 1 hour to perform polymerization and then cooled 28° C. to obtain core resin particle dispersion 1.

Preparation of Core Resin Particle Dispersion 2:

First Step Polymerization:

Into a reaction vessel equipped with a stirrer, a temperature sensor, a condenser, a temperature controller and a nitrogen-introducing device was added a solution of 3.5 parts by mass of sodium polyoxyethylene (2) dodecy ether sulfate dissolved in 1300 parts by mass of deionized water and heated to 80° C. Further thereto, 406 parts by mass of styrene, 73 parts by mass of n-butyl acrylate, 34 parts by mass of methacrylic acid, 8 parts by mass of n-octylmercatan and 56 parts by mass of Electol WEP-5 (esters, produced by Nippon Yushi Co., Ltd.), which were heated to 80° C., were added and mixed to obtain a mixture. The mixture was further mixed over 30 minutes by a mechanical disperser provided with a circulation path (CREAMIX, produced by M-Technique Co., Ltd.) to obtain a dispersion containing emulsified particles (oil droplets).

Subsequently, to this dispersion was added a polymerization initiator solution of 18 parts by mass of potassium persulfate dissolved in 340 parts by mass of deionized water. The mixture was further mixed over 1 hour with heating at 80° C. to perform polymerization to obtain a resin particle dispersion.

Second Step Polymerization:

To the foregoing resin particle dispersion were added 11 parts by mass of potassium persulfate dissolved in 200 parts by mass of deionized water and further thereto, a monomer solution composed of 490 parts by mass of styrene, 70 parts by mass of n-butyl acrylate and 8 parts by mass of n-octylmercaptan were dropwise added over 3 hours under a temperature condition of 82° C.

After completing addition, the mixture was further stirred over 1 hour to perform polymerization and then cooled to 28° C. to obtain core resin particle dispersion 2.

Preparation of Resin Particle Dispersion for Shell

Preparation of Resin Particle Dispersion 1 Used for Shelling:

First Step Polymerization:

Into a reaction vessel equipped with a stirrer, a temperature sensor, a condenser, a temperature controller and a nitrogen-introducing device was added a solution of 5 parts by mass of sodium polyoxyethylene (2) dodecy ether sulfate dissolved in 1900 parts by mass of deionized water and heated to 80° C. Further thereto, a monomer solution of 406 parts by mass of styrene, 73 parts by mass of n-butyl acrylate, 34 parts by mass of methacrylic acid, 8 parts by mass of n-octylmercaptan, 338 parts by mass of Electol WEP-5 (esters, produced by Nippon Yushi Co., Ltd., heat quantity of fusion heat: 154 J/g), which were heated to 80° C., were added and mixed to obtain a mixture. The mixture was further mixed over 30 minutes by a mechanical disperser provided with a circulation path (CREAMIX, produced by M-Technique Co., Ltd.) to obtain a dispersion containing emulsified particles (oil droplets).

Subsequently, to this dispersion was added a polymerization initiator solution of 18 parts by mass of potassium persulfate dissolved in 340 parts by mass of deionized water. The mixture was further mixed over 1 hour with heating at 80° C. to perform polymerization to obtain a resin particle dispersion.

Second Step Polymerization:

To the foregoing resin particle dispersion was added 5 parts by mass of potassium persulfate dissolved in 100 parts by mass of deionized water and further thereto, a monomer solution composed of 246 parts by mass of styrene, 35 parts by mass of n-butyl acrylate and 4 parts by mass of n-octylmercaptan were dropwise added over 3 hours under a temperature condition of 82° C.

After completing addition, the mixture was further stirred over 1 hour to perform polymerization and then cooled to 28° C. to obtain a shell resin particle dispersion 1 used for shelling.

Preparation of Resin Particle Dispersion 2 for Shelling:

A shell resin particle dispersion 2 used for shelling was prepared in the same manner as the foregoing resin particle dispersion 1 for shelling, except that Electol WEP-5 used in preparation of the foregoing resin particle dispersion 1 used for shelling was replaced by HNP-0190 (microcrystallines, produced by Nippon Seiro Co., Ltd., heat quantity of fusion: 145 J/g).

Preparation of Resin Particle Dispersion 3 for Shelling:

A shell resin particle dispersion 3 used for shelling was prepared in the same manner as the foregoing resin particle dispersion 1 for shelling, except that Electol WEP-5 used in preparation of the foregoing resin particle dispersion 1 used for shelling was replaced by FNP 0090 (Fisher Tropsch type, produced by Nippon Seiro Co., Ltd., heat quantity of fusion: 196 J/g).

Preparation of Resin Particle Dispersion 4 for Shelling:

A shell resin particle dispersion 3 used for shelling was prepared in the same manner as the foregoing resin particle dispersion 1 for shelling, except that Electol WEP-5 used in preparation of the foregoing resin particle dispersion 1 used for shelling was replaced by L-9936 (esters, produced by Riken Vitamin Co., Ltd., heat quantity of fusion: 123 J/g).

Preparation of Clear Toner 1

Formation of Core Particle:

Into a reaction vessel equipped with a stirrer, a temperature sensor, a condenser, and a temperature controller was added the foregoing core resin particle dispersion 1 in a solid content of 419 parts by mass, and 2 parts by mass of sodium polyoxyethylene-2-dodecyl ether sulfate dissolved in deionized water of 900 parts by mass, and after adjusting the liquid temperature to 25° C., the pH was adjusted to 10 by addition of an aqueous 25% by mass sodium hydroxide solution.

Subsequently, an aqueous solution of 70 parts by mass of magnesium chloride dissolved in 105 parts by mass of deionized water was added thereto over 30 minutes with stirring at 30° C., and after maintained for 3 minutes, the temperature was raised to 80° C. over 60 minutes and the particle growth reaction continued, while maintaining the temperature at 85° C.

In this state, the particle size of aggregated particles was measured by Coulter Multisizer (produced by Beckman Coulter Corp.) and when the particle size reached 5.5 μm, an aqueous solution of 15 parts by mass of sodium chloride dissolved in 58 parts by mass of deionized water to terminate the growth of particles, whereby a dispersion of core particles were formed.

Formation of Shell Layer:

To the foregoing dispersion of core particles, the resin particle dispersion 1 used for shelling was added in a solid content of 34 Parts by mass over 25 minutes.

A small amount of the thus obtained dispersion was sampled and charged into a centrifugal separator, and after confirming that the supernatant was transparent, an aqueous solution of 60 parts by mass of sodium chloride dissolved in 232 parts by mass of deionized water was added to the dispersion to complete shelling and ripening was further carried out at 88° C. to allow fusion of particles to proceed until the average circularity measured by FPIA-2100 reached 0.960. Thereafter, the liquid temperature was lowered to 30° C. and the pH was adjusted to 2.0 and stirring was stopped, whereby a shell layer was formed on the core particle.

The thus obtained dispersion of particles of the core/shell structure was subjected to solid/liquid separation in a basket type centrifugal separator (MARK 3, type 60×40, produced by Matsumoto Kikai Co., Ltd.) to form a wet cake of particles. The wet cake was washed with deionized water of 45° C. until the electric conductivity of the filtrate from the basket type centrifugal separator reached 5 μS/cm, and transferred to a dryer (Flash Jet Drier, produced by Seishi Kigyo Co., Ltd.) and dried until it reached a water content of 1.0% by mass, whereby clear toner parent particle 1 was obtained.

External Additive Treatment:

To the obtained clear toner parent particle 1 were added external additives, as shown below, and an external addition treatment was conducted in a Henshell Mixer (produced by Mitsui Miike Kogyo Co., Ltd.), whereby Clear Toner 1 was prepared.

| | |
|---|---|
| Hexamethylsilazane-treated Silica | 1.0 parts by mass |
| n-Octylsilane-treated titanium dioxide | 0.3 part by mass |

An external addition treatment in a Henshell Mixer was conducted under the condition of the circumferential speed of the stirring blade of 35 m/sec, a treatment temperature of 35° C. and a treatment time of 15 minutes.

Preparation of Clear Toners 2-9

Clear toners 2-9 were each prepared in the same manner as the clear toner 1, except that the amounts of the core resin particle dispersion 1 and the shell resin particle dispersion 1 were changed or the shell resin particle dispersion 1 was replaced by any one of shell resin particle dispersions 2-4.

Preparation of Clear Toner 10

Into a reaction vessel equipped with a stirrer, a temperature sensor, a condenser, and a temperature controller was added the foregoing core resin particle dispersion 1 in a solid content of 450 parts by mass, and 2 parts by mass of sodium polyoxyethylene-2-dodecyl ether sulfate dissolved in deionized water of 900 parts by mass, and after adjusting the liquid temperature to 25° C., the pH was adjusted to 10 by addition of an aqueous 25% by mass sodium hydroxide solution.

Subsequently, an aqueous solution of 70 parts by mass of magnesium chloride dissolved in 105 parts by mass of deionized water was added thereto over 30 minutes with stirring at 30° C., and after maintained for 3 minutes, the temperature was raised to 80° C. over 60 minutes and the particle growth reaction continued, while maintaining the temperature at 85° C.

In this state, the particle size of aggregated particles was measured by Coulter Multisizer (produced by Beckman Coulter Corp.) and when the particle size reached 5.0 μm, an aqueous solution of 75 parts by mass of sodium chloride dissolved in 290 parts by mass of deionized water to terminate the growth of particles, whereby a dispersion of core particles were formed.

Further, ripening was conducted with stirring at a liquid temperature of 88° C. to allow melting coalescence between particles until reached an average circularity of 0.960, measured by FPIA-2100 (produced by Sysmex Co., Ltd.); then, the mixture was cooled to 30° C., and adjusted to a pH of 2.0 with hydrochloric acid, and stirring was stopped.

The thus obtained dispersion of particles was subjected to solid/liquid separation in a basket type centrifugal separator (MARK 3, type 60×40, produced by Matsumoto Kikai Co., Ltd.) to form a wet cake of particles. The wet cake was washed with deionized water of 45° C. until the electric conductivity of the filtrate from the basket type centrifugal separator reached 5 μS/cm, and transferred to a dryer (Flash Jet Drier, produced by Seishi Kigyo Co., Ltd.) and dried until it reached a water content of 1.0% by mass, whereby clear toner parent particle 10 was obtained.

External Additive Treatment:

To the obtained clear toner parent particle 7 were added external additives, as shown below, and an external addition treatment was conducted in a Henshell Mixer (produced by Mitsui Miike Kogyo Co., Ltd.), whereby Clear toner 1 was prepared.

| | |
|---|---|
| Hexamethylsilazane-treated Silica | 1.0 parts by mass |
| n-Octylsilane-treated titanium dioxide | 0.3 part by mass |

An external addition treatment in a Henshell Mixer was conducted under the condition of the circumferential speed of the stirring blade of 35 msec, a treatment temperature of 35° C. and a treatment time of 15 minutes.

In Table 1 are shown core resin particles and an amount thereof, and shell resin particles and an amount thereof which were used for preparation of each of Clear toners 1-10, a number-based median diameter ($D_{50}$), a shell layer ratio (% by mass), a heat quantity of fusion and S2/S1.

In Table 1, the median diameter ($D_{50}$), heat quantity of fusion and S2/S1 are values obtained by the methods described earlier.

Preparation of Developer

Into a high-speed mixer provided with a stirring blade were added 100 parts by mass of ferrite core particles and 5 parts by mass of a copolymeric resin particles of cyclohexyl methacrylate and methyl methacrylate (copolymeric ratio of 5/5) and stirred at 30° C. for 30 minutes to form a resin coat layer on the surfaces of the ferrite core particles, and thereby, a ferrite carrier exhibiting a volume-based median diameter ($D_{50}$) of 60 μm was obtained.

To each of the afore-described clear toners 1-10 was added the foregoing carrier so that the clear toner content was 4% by mass, whereby developers 1-10 were each prepared.

Evaluation

Evaluation of Wrapping:

There was prepared an apparatus for evaluation in which a clear toner particle layer-forming section 20S shown in FIG. 4, as an evaluation device for wrapping, was additionally provided to an electrophotographic image forming apparatus (bizhub C353, produced by Konica Minolta Business Technologies Inc.).

To the foregoing apparatus were loaded each of the clear toners and the developer and evaluation was made with respect to occurrence of wrapping of an image support onto a heating roll when forming a clear toner particle layer of 4 g/m$^2$ on the image support.

The image support employed a commercially available coated paper (OK Top-coated Paper of a weight of 157 g/m$^2$ and a paper thickness of 131 μm, produced by OJI Seishi Co., Ltd.) and the evaluation environment was set to ordinary temperature and humidity.

Specifically, evaluation was made with respect to wrapping of the foregoing image support onto the heating roller when 100 sheets of prints were prepared with feeding the image support in the transverse direction, based on the following criteria in which ranks A, B and C were acceptable in practice.

A: No wrapping occurred in all of 100 sheets and no phenomenon was observed in which an image support adhered to a heating roll and arose,

TABLE 1

| | Core | | Shell | | Clear Toner | | | | | |
|---|---|---|---|---|---|---|---|---|---|---|
| Clear Toner No. | | Solid Content (part by mass) | Resin Particle Dispersion for Shelling | Solid Content (part by mass) | Particle Size*1 (μm) | Shell Layer Ratio*2 (% by mass) | Heat Quantity of Fusion (J/g) | S2/S1 | Content of Releasing Agent (% by mass) | Remark |
| 1 | *3 | 419 | 1 | 32 | 6.0 | 7 | 3.0 | 0.82 | 0.6 | Inv. |
| 2 | *3 | 369 | 1 | 81 | 6.0 | 18 | 7.7 | 0.73 | 1.5 | Inv. |
| 3 | *3 | 351 | 1 | 99 | 6.0 | 22 | 9.0 | 0.60 | 2.0 | Inv. |
| 4 | *3 | 345 | 1 | 103 | 6.0 | 23 | 9.5 | 0.50 | 2.1 | Inv. |
| 5 | *3 | 369 | 2 | 81 | 6.0 | 18 | 6.9 | 0.73 | 1.5 | Inv. |
| 6 | *3 | 369 | 3 | 81 | 6.0 | 18 | 9.4 | 0.73 | 1.5 | Inv. |
| 7 | *3 | 369 | 4 | 81 | 6.0 | 18 | 6.2 | 0.73 | 1.5 | Inv. |
| 8 | *3 | 338 | 1 | 113 | 6.0 | 25 | 11.1 | 0.50 | 2.2 | Comp. |
| 9 | *3 | 428 | 1 | 23 | 6.0 | 5 | 2.2 | 0.80 | 0.4 | Comp. |
| 10 | *4 | 450 | — | — | 5.6 | — | 7.4 | 0.42 | 1.8 | Comp. |

*1volume-based median diameter ($D_{50}$)

*2(shell layer)/(core portion + shell layer) × 100

*3: resin particle dispersion 1 for core

*4: resin particle dispersion 2 for core

B: No wrapping occurred in all of 100 sheets but a phenomenon was observed in 1-3 sheets in which an image support adhered to a heating roll and arose, C: No wrapping occurred in all of 100 sheets but a phenomenon was observed in at least 4 sheets in which an image support adhered to a heating roll and arose, D: Wrapping occurred.

Evaluation of Glossiness:

Each of the clear toners was loaded to the foregoing image forming apparatus and there were prepared 100 sheets of a printed image having a clear toner particle layer in an amount of 4 g/m$^2$ on an image support (OK Top Coat Paper, weight: 157 μg/m$^2$, paper thickness: 131 μm).

These 100 sheets of a printed image were loaded to a glossing device shown in FIG. 5 under the conditions described below to prepare 100 sheets of a glossy image.

Conditions Set for Glossing Device:

(a) Material of belt member: a PFA layer (of a 10 μm thickness) provided on a polyimide film (of a 10 μm thickness), (b) Surface roughness of belt member: Ra=0.4 μm, (c) Specification of heating roll and pressure roll:

Heating roll; aluminum substrate of 100 mm outer diameter and 10 min thickness,

Pressure roll; aluminum substrate of 100 mm outer diameter and 10 nm thickness, provided thereon with a 3 mm thick silicone rubber layer, provided that a halogen lamp is disposed in the interior of the heating roll and the surface temperature of the heating roll being set to 155° C. (temperature-controlled by a thermistor), Nip width between heating roll and pressure roll; 11 mm, (d) Image support temperature at the position of release roll: cooling condition set to 50±5° C., (e) Distance from nip portion of heating and pressure rolls: 620 mm, (f) Image support transporting speed: 150 mm/sec, (g) Image support transport rate: 150 mm/sec (h) Evaluation environment: ordinary temperature and humidity (20° C., 50% RH)

The glossiness of each of glossy images prepared above was measured by using a gloss-meter (GMX-203, produced by Murakami Shikisai Gijutsu Kenkyusho Co., Ltd.), based on JIS Z 8741, 1997. Glossiness was determined in such a manner that 10 sheets were randomly chosen and five points of a central portion and four corners of an image were measured and the average thereof was defined as glossiness. Glossiness of 80 or more was acceptable in practice.

Evaluation of Gloss Evenness:

Glossy images of 100 sheets prepared above were visually observed and evaluated with respect to gloss evenness, based on the following criteria:

Evaluation Rank:

A: No gloss unevenness was observed in all of 100 sheets,

B: Gloss unevenness was observed in 1-3 sheets of 100 sheets, but acceptable in practice, C: Gloss unevenness was observed in 4 or more sheets of 100 sheets, and not acceptable in practice.

Evaluation results are shown in Table 2.

TABLE 2

| Clear Toner | Evaluation Result | | | |
|---|---|---|---|---|
| No. | Wrapping | Glossiness | Gloss Evenness | Remark |
| 1 | B | 83 | B | Example 1 |
| 2 | A | 82 | A | Example 2 |
| 3 | A | 81 | A | Example 3 |

TABLE 2-continued

| Clear Toner | Evaluation Result | | | |
|---|---|---|---|---|
| No. | Wrapping | Glossiness | Gloss Evenness | Remark |
| 4 | A | 80 | B | Example 4 |
| 5 | A | 82 | A | Example 5 |
| 6 | A | 80 | A | Example 6 |
| 7 | B | 82 | B | Example 7 |
| 8 | A | 65 | A | Comparison 1 |
| 9 | D | 83 | D | Comparison 2 |
| 10 | C | 78 | D | Comparison 3 |

As is apparent from the evaluation results of table 2, it was proved that Toners 1-7 of Examples 1-7 satisfied in any of evaluation items and achieved the object of the present invention.

On the contrary, it was proved that toners 8-10 for comparison produced problems in either of evaluation items and could not achieve the object of the present invention.

What is claimed is:

1. A method of forming a glossy image, comprising the steps of:

(a) forming a clear toner particle layer with clear toner particles on an image support, (b) heating and pressing the clear toner particle layer formed on the image support, while bringing a surface of the clear toner particle layer into contact with a belt, and then (c) cooling the clear toner particle layer to form a clear toner layer, wherein the clear toner particles contain a binder resin and a releasing agent and exhibit a heat quantity of fusion of not less than 3.0 J/g and not more than 9.5 J/g, and the clear toner particles meeting the following requirement:

$$0.5 \leqq S2/S1 \leqq 1.0$$

wherein S1 represents a total area of releasing agent domains in a cross section of a clear toner particle and S2 represents a total area of releasing agent domains which exist within a region of 2 μm from the particle surface toward a center of gravity of the particle, and wherein the clear toner particles have a core/shell structure comprising a core and a shell layer and the releasing agent is contained only in the layer.

2. The method of claim 1, wherein prior to the step (a), the method comprises forming a print image with a toner on the image support.

3. The method of claim 1, wherein the heat quantity of fusion is a heat quantity of fusion at a time of temperature rise in a differential scanning calorimetry curve determined in differential scanning calorimetry.

4. The method of claim 1, wherein the clear toner particles exhibit a volume-based median diameter of not less than 5 μm and not more than 12 μm.

5. The method of claim 1, wherein the releasing agent is contained in an amount of not less than 0.5% by mass and not more than 5.0% by mass of a total mass of the clear toner particles.

6. The method of claim 2, wherein the releasing agent exhibits a heat quantity of fusion of not less than 80.0 J/g and not more than 250.0 J/g.

7. The method of claim 6, wherein the heat quantity of fusion is a heat quantity of fusion at a time of temperature rise in a differential scanning calorimetry curve determined in differential, scanning calorimetry.

8. The method of claim 1, wherein the clear toner particle layer is formed in an oilless heat-fixing device and the clear toner layer is formed in a glossing device.

* * * * *